US005150553A

United States Patent [19]

Commins et al.

[11] Patent Number: 5,150,553

[45] Date of Patent: Sep. 29, 1992

[54] HOLDOWN STRAP

[75] Inventors: Alfred D. Commins, Danville; Ernest A. Romeo, Healdsburg, both of Calif.

[73] Assignee: Simpson Strong-Tie Company, Inc., San Leandro, Calif.

[21] Appl. No.: 564,869

[22] Filed: Aug. 9, 1990

[51] Int. Cl.[5] ..... E02D 27/02; E04B 1/38

[52] U.S. Cl. ..... 52/264; 52/295; 52/699; 52/712; 52/713

[58] Field of Search ..... 52/264, 293, 294, 295, 52/296, 712, 713, 714, 699

[56] References Cited

U.S. PATENT DOCUMENTS

| | | | |
|---|---|---|---|
| 3,413,773 | 12/1968 | Fitzgerald | 52/295 |
| 4,202,149 | 5/1980 | Betrue, Sr. | 52/699 |
| 4,404,781 | 9/1983 | Gilb . | |
| 4,413,456 | 11/1983 | Gilb . | |
| 4,570,403 | 2/1986 | Dannemiller | 52/295 |
| 4,665,672 | 5/1987 | Commins et al. | 52/295 |
| 4,739,598 | 4/1988 | Jensen et al. | 52/295 |

OTHER PUBLICATIONS

Simpson Strong-Tie Catalog p. 5 copyright 1990.
Simpson Strong-Tie Catalog p. 13 copyright 1965.
Simpson Strong-Tie Catalog p. 11 copyright 1990.
Lumberlok Catalog p. 7 copyright 1988.
Simpson Strong-Tie Catalog p. 10 Copyright 1990.

*Primary Examiner*—Michael Safavi
*Attorney, Agent, or Firm*—James R. Cypher

[57] ABSTRACT

A holdown strap connection including an elongated sheet metal holdown strap for joining a generally vertical wood frame member such as a post or stud to a concrete foundation without the use of threaded anchor bolts washers and threaded nuts. The elongated sheet metal holdown strap includes a foot section embedded in the concrete, a transition section connected to the foot section which extends above the foundation past the outside edge of the wood mudsill and along a portion of the edge of the wood frame member and an elongated strap section connected to the transition section and extends in registration with the side face of the vertical wood frame member.

10 Claims, 7 Drawing Sheets

EMBOSS DOWN
32"
35"
8"
54
45° DOWN
55
51
45° UP
90° DOWN
NAIL TO FORM BOARDS
53
56
UP 90°
11"
9"
10"
15"
15"
14"
7"

1
50
54
34"
8"
33"
35"
32"
2
36"
37"
38"
55
51
11"
52
40
3
41
9"
10"
14"
15"
7"

HOLDOWN STRAP

BACKGROUND

This invention relates to a connection including a sheet metal strap for attaching the vertical members of a wood frame structure to a concrete foundation.

It is common practice to lay a wood mudsill board on top of a concrete foundation and then to toenail vertical wood stud members to the mudsill. In those areas of the country subject to earthquakes, hurricanes, tornadoes, flood, or tidal action which impose upward forces on the building structure it is standard practice to tie the structure to the concrete foundation.

The most commonly used system is to insert threaded bolts into the concrete, bore holes in the mudsill, insert the upstanding bolts through the holes and fasten the mudsill to the bolts with threaded nuts and washers. One piece sheet metal anchors have been embedded in the concrete and the straps nailed to the mudsill. These systems lack the ability to tie the studs directly to the foundation.

Another recently devised system requires the use of threaded bolts anchored in the foundation and an angled holdown is attached to the bolt at the seat portion and the upper portion is either bolted or nailed to the inside face of the vertical wood stud. This system is widely used and is satisfactory except for the fact that it is costly to accurately position the anchor bolts in the concrete, drill holes in the mudsill at just the right place and then attach the heavy holdown member to the bolt and to the vertical wood stud.

Still another system is to embed a strap member in the concrete and then nail or bolt the strap to the vertical wood stud. This system is relatively inexpensive, but the strap can only be attached to the outside edge of the vertical wood stud which makes it difficult, if not impossible to nail siding or plywood shear wall panels to the outside of the wood stud.

The situation is exacerbated when it is necessary to interpose a rim joist subfloor and floor plate between the stud and the mud sill. The anchor bolt and holdown system is far too cumbersome to use and the holdown strap system attached to the outside of the structure renders even more outside surface difficult, if not impossible to attach to.

SUMMARY OF THE INVENTION

An object of the present invention is to provide a holdown strap for connecting a vertical wood frame member such as a stud or post to a concrete foundation and which does not require the presetting of an anchor bolt in the concrete foundation.

Another object is to provide a holdown strap which connects to the face instead of the outside edge of the post or stud.

A further object is to provide a holdown strap capable of installation in a 6 inch concrete footing.

Still another object is to provide a holdown which minimizes edge cracking of the foundation.

A still further object is to provide a holdown which can be attached to a stud or post, span a floor plate, subfloor, rim joist and mudsill and still attach to a concrete foundation.

Another object is to provide a two piece holdown strap which can be assembled in the field.

Still another object is to provide a two piece holdown strap which can be installed on either side of the post or stud.

DESCRIPTION OF THE DRAWINGS

FIGS. 6 and 7 illustrate the manner in which either edge of the elongated strap section may be connected to the transition section of the elongated sheet metal holdown strap connector.

DESCRIPTION

Figure 1:
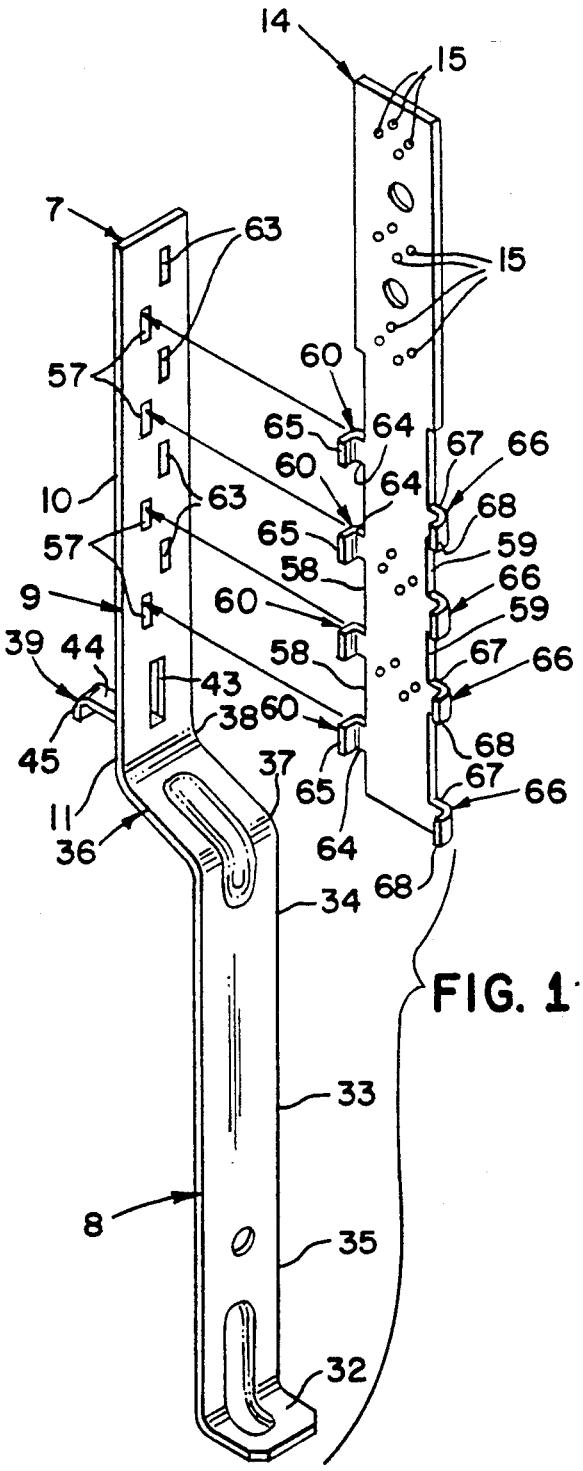
FIG. 1 is a perspective view of one form of elongated sheet metal holdown strap of the present invention with the elongated strap section detached from the foot and transition section.
Figure 2:
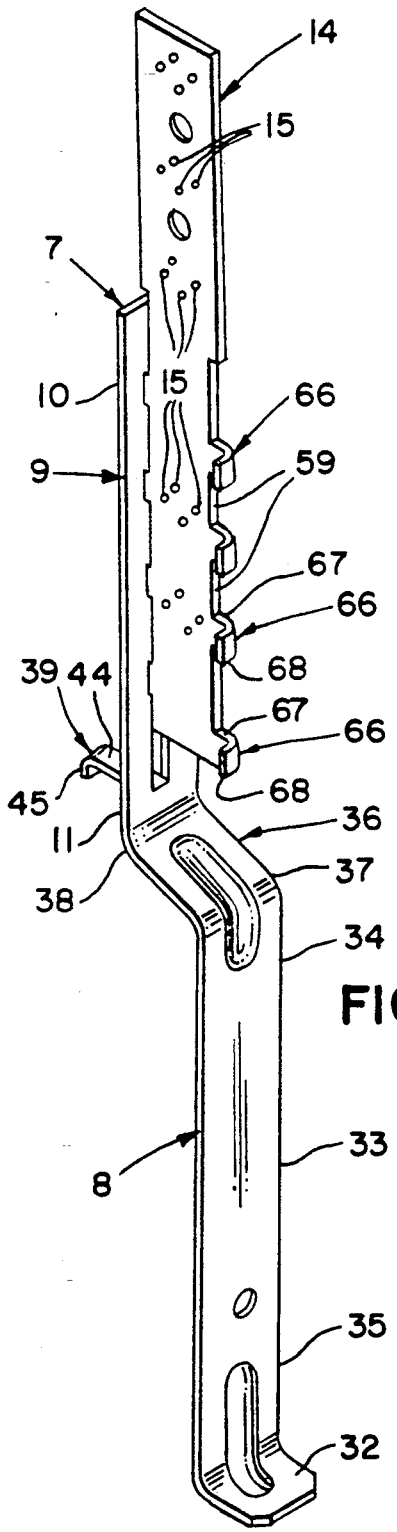
FIG. 2 is a perspective view of the elongated sheet metal holdown strap illustrated in FIG. 1 in one of its assembled forms.

The present invention is a holdown strap connection consisting of: a concrete foundation 1 having an upper surface 2 and a side surface 3; a generally horizontally extending wood mudsill 4 resting on a concrete foundation 1; a generally vertical wood frame member such as a 2 ×4, doubled 2 ×4, 4 ×4 post or larger timber member 5 having an outside edge 13 mounted on the wood mudsill 4 and having a side face 6; an elongated sheet metal holdown stray connector 7 including: a foot section 8 embedded in the concrete foundation 1 extending from within the concrete foundation 1 to a location adjacent the side surface 3 of foundation 1; a transition section 9 having an upper portion 10 and a lower portion 11 are connected to the foot section 8 and extend from the concrete foundation 1 past the outside edge 12 of the wood mudsill and along a portion of the edge 13 of the vertical wood frame member 5, and an elongated strap section 14 connected to the upper portion 10 of the transition section 9 and extending and in registration with the side face 6 of the vertical wood frame member 5 and formed with a plurality of fastener openings 15 therethrough; and fastener means such as nails 16 dimensioned for insertion through the fastener openings 15 in the elongated strap section 14 of the elongated sheet metal holdown strap connector 7 and into the vertical wood frame member 5.

The aforesaid description refers to all of the drawings, but the numbering system refers especially to the form of the invention illustrated in FIGS. 1, 2, 3, 4, 6, 10, 11, and 12.

Figure 5:
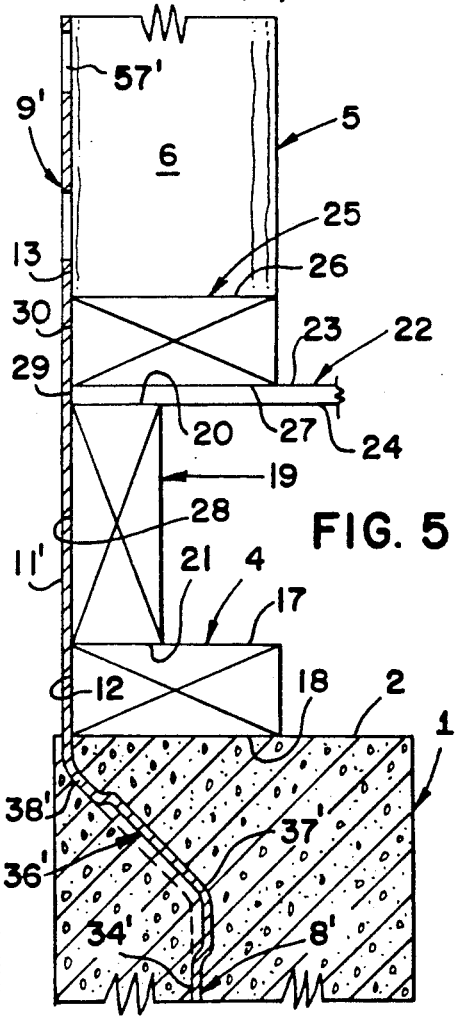
FIG. 5 is a side view of a portion of another form of the invention illustrated in FIG. 1 installed on a concrete foundation and including a mudsill, a rim joist, a subfloor a floor plate, a vertical wood frame member and a portion of elongated sheet metal holdown strap. The elongated strap section has been omitted for clarity.
Figure 7:
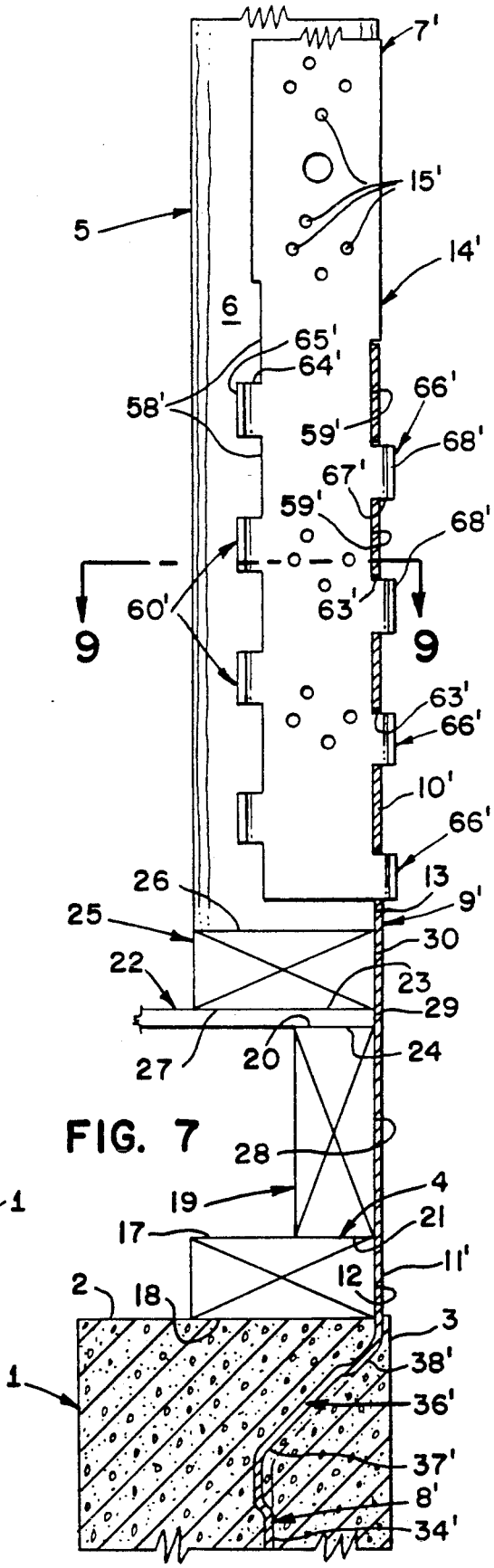
FIG. 7 is a side elevation view of a portion of another form of holdown strap connection elongated in which the sheet metal strap connector is installed in a concrete foundation and connected to a vertical frame member which rests on a sole plate, subfloor rim joist and mudsill.
Figure 8:
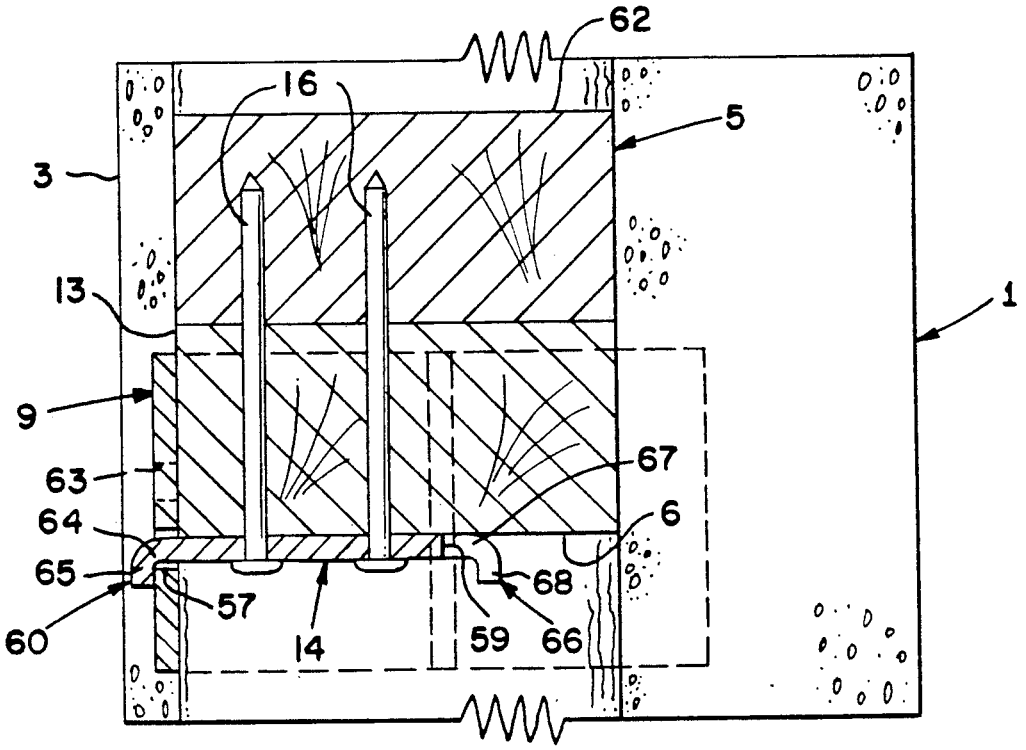
FIG. 8 is a cross sectional view taken along line 8–8 of FIG. 6.
Figure 9:
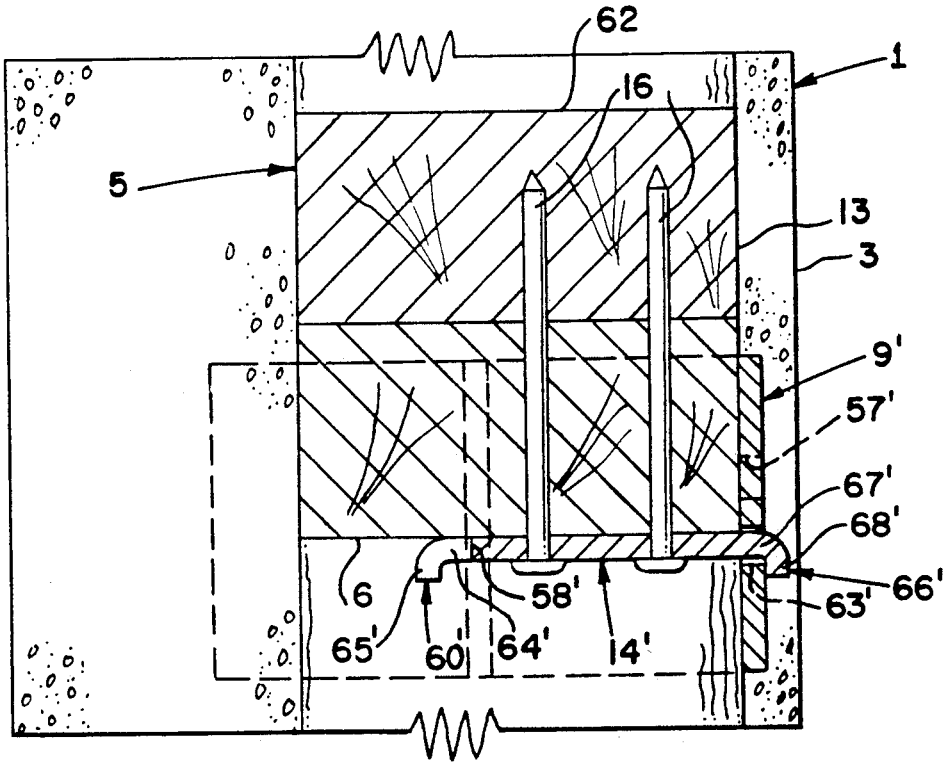
FIG. 9 is a cross sectional view taken along line 9–9 of FIG. 7.
Figure 10:
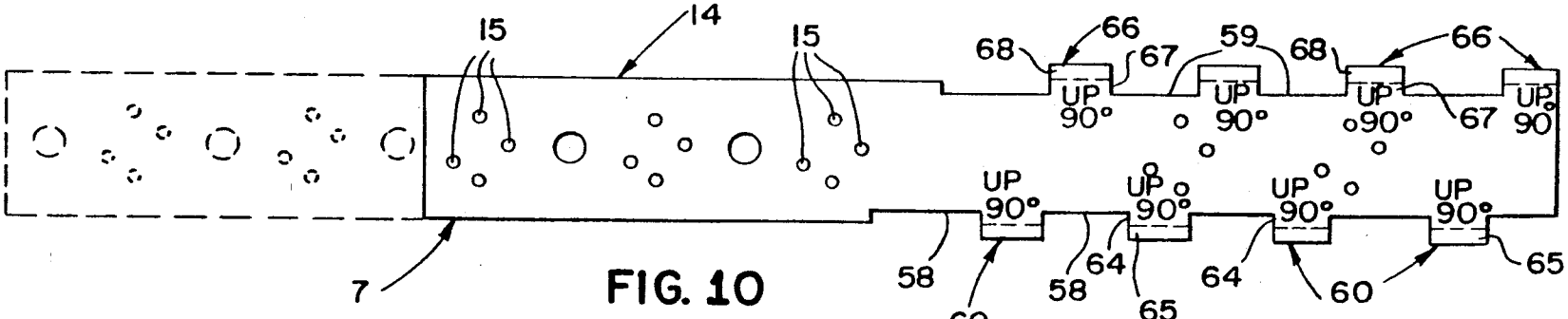
FIG. 10 is a top plan view of a blank of a portion of the elongated strap section of the present invention. The dashed lines indicate the added portion used to construct the alternate form of the invention illustrated in FIGS. 5 and 7.
Figure 11:
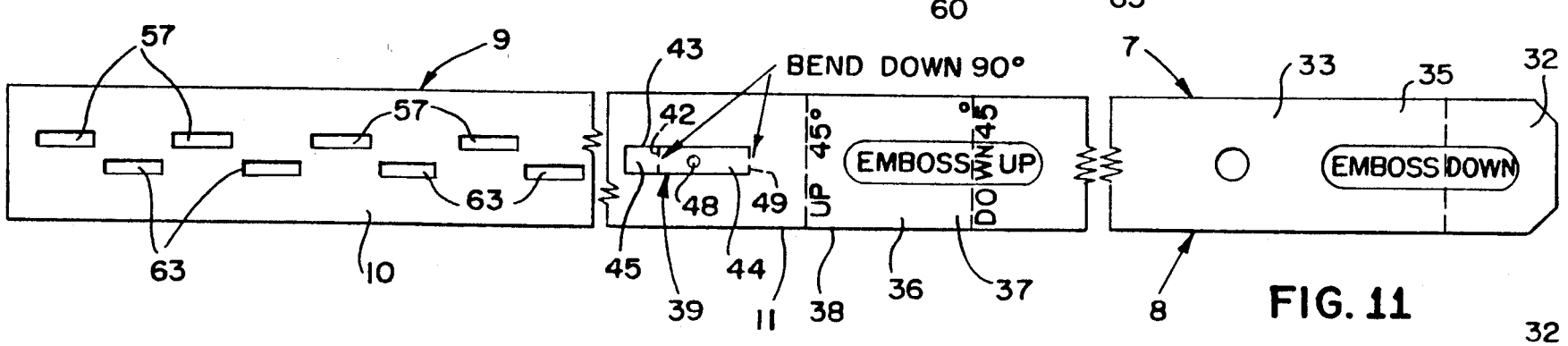
FIG. 11 is a top plan view of a blank of the foot section and transition section of the elongated sheet metal holdown strap connector of the present invention.
Figure 12:
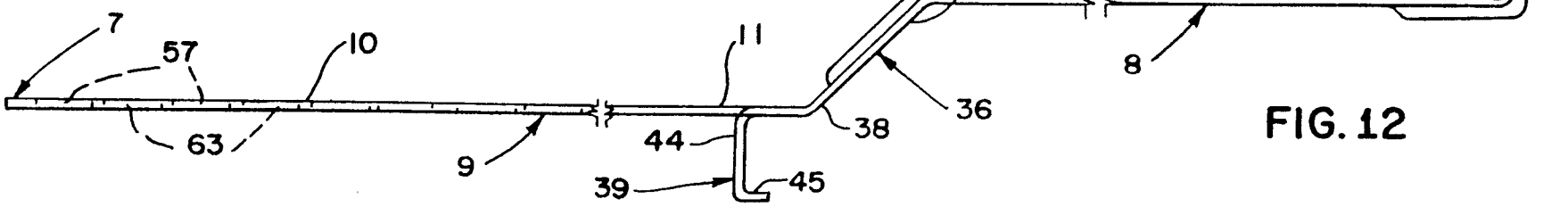
FIG. 12 is a side view of a portion of the elongated sheet metal holdown strap connector illustrated in FIG. 11 with portions removed in the upper and lower sections so that the holdown strap may be illustrated on one sheet of the drawings.

A modified form of the invention is illustrated in FIGS. 5, 7, and 9. The modified form of the holdown strap connection consists of: a concrete foundation 1 having an upper surface 2 and a side surface 3; a generally horizontally extending wood mudsill 4 having an upper side 17 and a lower side 18 resting on the concrete foundation 1; a rim joist member 19 having an upper edge 20, a side 28 and a lower edge 21 resting on the upper side 17 of the wood mudsill 4; a subfloor member 22 having an upper face 23, an edge 29, and a lower face 24 resting on the upper edge 20 of the rim joist member 19; a wood sole plate 25 having an upper side 26, an edge 30 and a lower side 27 resting on the upper face 23 of the subfloor member 22; a generally vertical wood frame member 5 having an outside edge 13 mounted on the wood upper side 26 of the wood sole plate 25; an elongated sheet metal holdown strap connector 7' including: a foot section 8' embedded in the concrete foundation 1, a transition section 9' having an upper portion 10' and a lower portion 11' integrally connected to the foot section 8' and extending from the concrete foundation 1 past the outside edge 12 of the wood mudsill 4, along the side 28 of the rim joist 19, along the edge 29 of the subfloor 22; along the edge 30 of the sole plate 25 and along a portion of the edge 13 of the vertical wood frame member 5, and an elongated strap section 14' connected to the upper portion 10' of the transition section 9' and extending and in registration with the side face 6 of the vertical wood frame member 5 and formed with a plurality of fastener openings 15 therethrough; and fastener means such as nails 16 dimensioned for insertion through the fastener openings 15 in the elongated strap section 14' of the elongated sheet metal holdown connector strap 7' and into the vertical wood frame member 5.

Referring to FIGS. 1, 2, 3, 4, 6, 8, and 12, the holdown strap connection of the present invention further comprises a foot section 8 including a distal end 32 formed at an angle for mechanical interlock with the concrete foundation 1; the foot section 8 includes a main portion 33 having an upper section 34 and a lower section 35 integrally connected to the distal end 32 and disposed in a generally vertical plane within the concrete foundation 1; a proximal section 36 having a lower portion 37 integrally connected to the main portion 33 of the foot section 8 and an upper portion 38 integrally connected to the lower portion 11 of the transition section 9; and a substantial length of the proximal section 36 is disposed at an angle to the main portion 33 of the foot section 8.

In the modified form of the invention illustrated in FIGS. 5 and 7, foot section 8' includes a distal end identical to distal end 32, formed at an angle for mechanical interlock with the concrete foundation 1; a main portion identical to main portion 33 having an upper section 34' and a lower section integrally connected to the distal end and disposed in a generally vertical plane within the concrete foundation 1; a proximal section 36' having a lower portion 37' integrally connected to the upper section 34' of the foot section 8' and an upper portion 38' integrally connected to the lower portion 11' of the transition section 9'; and a substantial length of the proximal section 36' is disposed at an angle to the main portion of the foot section 8'.

For ease in installing the elongated sheet metal holdown strap connector 7, form attachment means 39 is formed in the transition section 9 of the elongated sheet metal holdown strap connector 7 for temporarily attaching the transition section 9 to the top edge 40 of form board 41 positioned in registration with side surface 3 of concrete foundation 1 and adjacent upper surface 2 of the concrete foundation. Specifically, attachment means 39 is punched out of the metal forming a slot 43 and bent along bend lines 42 and 49 forming a J-hook with an arm 44 which rests on top edge 40 of form board 41 and hook end 45 which grasps face 46 of form board 41. To insure the foot and transition sections 8 and 9 of the elongated sheet metal holdown strap connector 7 remain in place during pouring of the concrete foundation 1, a nail fastener 47 may be driven through a nail opening 48 formed in arm 44 and into form board 41.

The form attachment means for the modified form of transition section 9' illustrated in FIGS. 7 and 9 is identical to the attachment means 39 above described and is installed in the identical manner.

FIGS. 13 -18 illustrate two other forms of the invention. These two forms of the invention are constructed from lighter gage material which may be bent readily in the field. The primary difference between these two forms and the previously described forms are the fact that the transition sections 9'' and 9'''are integrally connected to the elongated strap sections 14'' and 14'''.

Figures 13, 18:
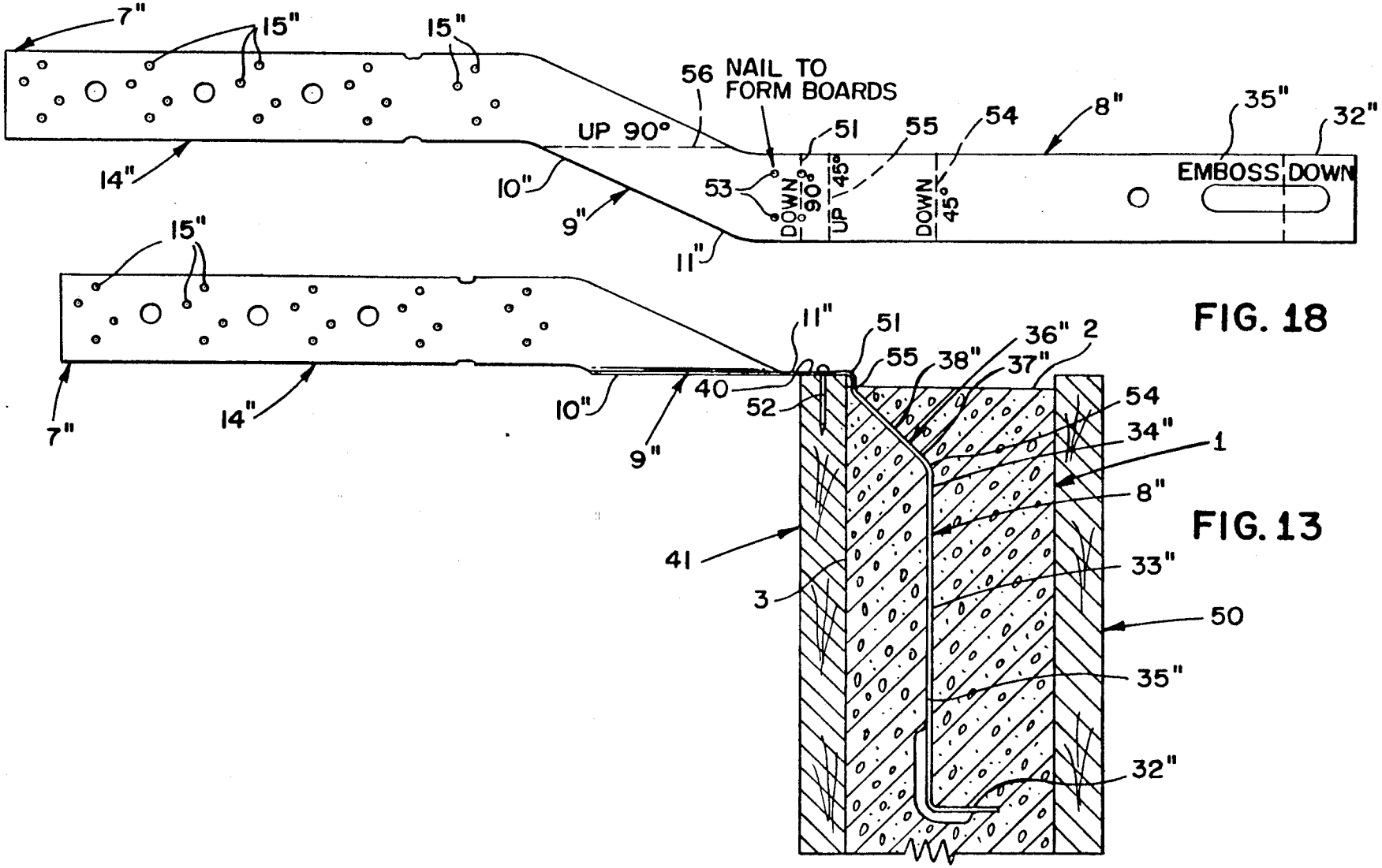
FIG. 13 is a side elevation view of a blank of still another form of the present invention. The elongated sheet metal holdown connector is illustrated installed in concrete between two form boards.
FIG. 18 is a top plan view of the blank of the elongated sheet metal holdown strap connector illustrated in FIG. 13.

Referring specifically to the form of the invention illustrated in FIGS. 13, 14, 16, and 18, parts which are like or identical to the parts described in the previously described holdown strap connection are numbered with like numbers, but with the addition of the symbol (") or ("') after the number. As shown in FIG. 18, elongated strap section 14'' is integrally connected to transition section 9'' along bend line 18. To form the elongated sheet metal holdown strap connector 7'' from the blank, a 45° bend down is made along bend line 54 and a 45° bend up is made along bend line 55. A 90° bend up is then made along bend line 56.

Installation of elongated sheet metal holdown strap connector 7'' is illustrated in FIG. 13 and is described as follows. Form boards 41 and 50 are installed. Prior to or shortly after the wet concrete is poured between the form boards, elongated sheet metal holdown strap connector 7'' is installed with the foot section 8'' between the form boards extending from within the concrete foundation 1 to a location adjacent the side surface 3 of foundation 1. Main portion 33'' is installed essentially vertically with the distal end 32'' in the lower section of the concrete. The elongated strap section 14'' may be installed in a nearly vertical position but, preferably, the elongated sheet metal holdown strap connector 7'' is bent at a 90° angle along bend line 51 so that the elongated strap section 14'' will be out of the way. To hold the elongated sheet metal holdown strap connector 7'' in position, nails 52 may be driven thought fastener openings 53 into form board 41. After the concrete foundation 1 has hardened, the elongated strap section 14'' is bent upwardly 90° along bend line 51 and then attached to vertical wood frame member 5 by hammering nails through fastener openings 15''.

Figures 14, 15, 16, 17:
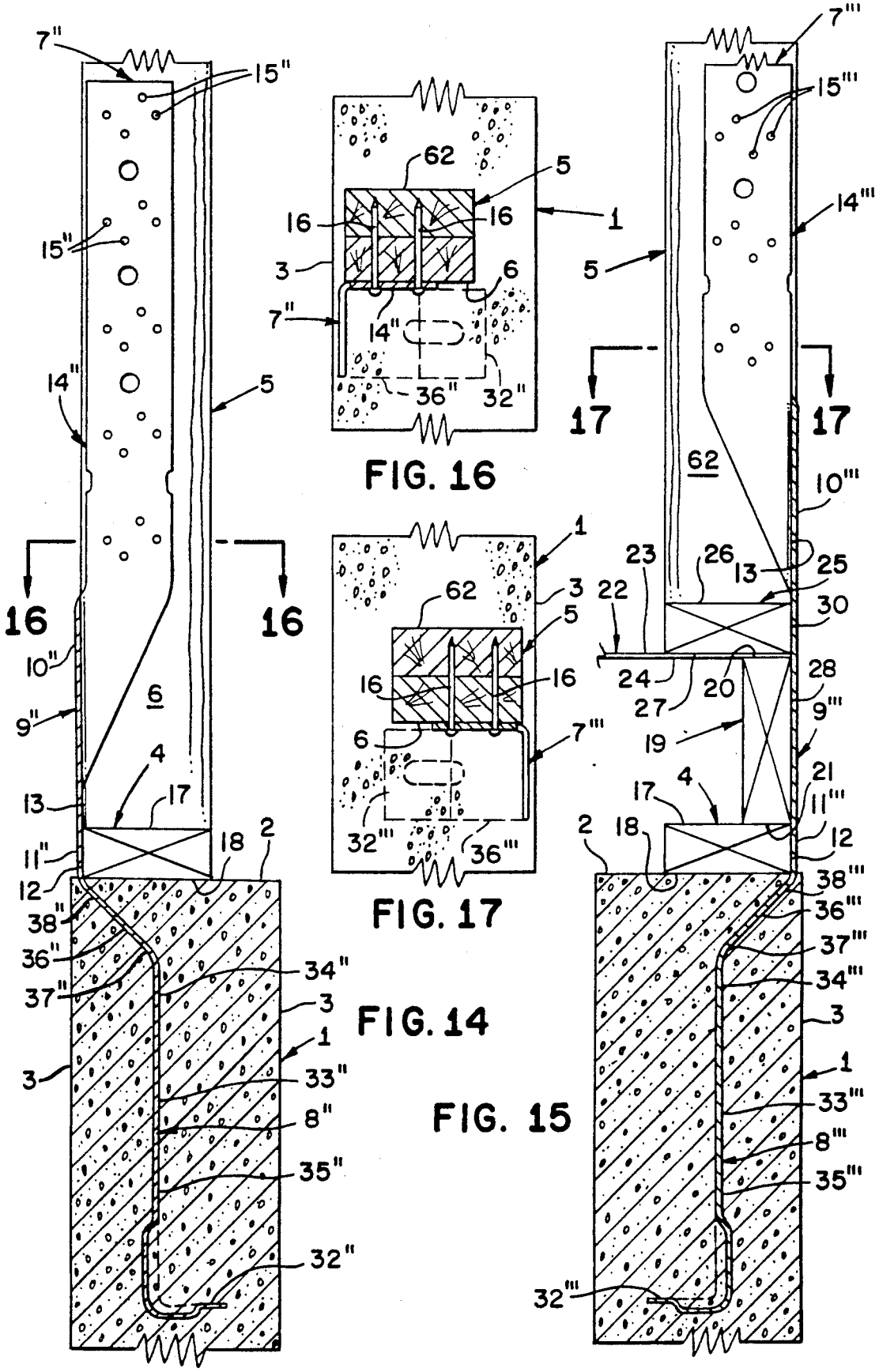
FIG. 14 is a side elevation view with portions in cross section of the form of the invention illustrated in FIG. 13 installed in a typical installation in a concrete footing and attached to a vertical wood member resting on top of a mudsill.
FIG. 15 is a side elevation view with portions in cross section of still another form of the invention, similar to the form illustrated in FIG. 14, but with the elongated sheet metal holdown strap connector spanning a mudsill, a rim joist, a subfloor and a sole plate.
FIG. 16 is a cross sectional view taken along line 16—16 of FIG. 14.
FIG. 17 is a cross sectional view taken along line 17-17 of FIG. 15.

The form of the invention illustrated in FIGS. 15 and 17 is identical to the invention illustrated in FIGS. 13, 14, 16 and 18 except that the transition section 9'', is longer so that the elongated sheet metal holdown strap connector 7'' can span the rim joist 19, the subfloor 22 and the sole plate 25. Like or identical parts have been given identical numbers but with the addition of the symbol ("').

Referring again to the form of the invention illustrated in FIGS. 1–4, 6, 8, and 10–12, transition section 9 has an upper portion 10 formed with strap section attachment means which may be slots 57 and a lower portion 11 integrally connected to the foot section 8 and extending from the concrete foundation 1. Transition section 9 of elongated sheet metal holdown strap connector 7 has a length such that, after the poured concrete foundation 1 hardens and form boards 41 and 50 are removed and the wood mudsill 4 and vertical frame member have been installed, transition section 9 will extend past the outside edge 12 of the wood mudsill 4 and along a portion of the edge of the vertical wood frame member 5. Elongated strap section 14 has first and second edges 58 and 59 formed with transition section attachment means such as J-hooks 60 formed for selected attachment to the strap section attachment means 57 formed in the transition section 9 and extending and in registration with the side face 6 of the vertical wood frame member 5 and formed with a plurality of fastener openings 15 therethrough.

Referring to the form of the invention illustrated in FIGS. 5, 7, and 9, transition section 9' has an upper portion 10' formed with strap section attachment means which may be slots 63', a lower portion 11' integrally connected to the foot section 8' and extending from the concrete foundation 1 past the outside edge 12 of the wood mudsill 4, along the side 28 of the rim joist 19, along the edge 29 of the subfloor 22, along the edge 30 of the sole plate 25 and along a portion of the edge 13 of the vertical wood frame member 5. An elongated strap section 14' has first and second side edges 58' and 59' and is formed with transition section attachment means 60' and 66' formed for selected attachment to the strap section attachment means 63' and 57', formed in the transition section 9'. Elongated strap sections 14' and is in registration with the side face 6 of the vertical wood frame member 5.

In both forms of the invention illustrated in FIGS. 1–4, 6, 8, and 10 -12, and in FIGS. 5, 7 and 9; the transition section attachment means 60 and 60' formed in the elongated strap sections 14 and 14' are a plurality of hook shaped tabs having projections 64 and 64' and distal ends 65 and 65' dimensioned for receipt within the slot openings 57 and 57' formed in the transition sections 9 and 9' for preventing relative axial movement of the transition sections 9 and 9' and the elongated strap sections 14 and 14'.

The transition section attachment means may include a plurality of J-hook shaped tabs 60, 60', 66, and 66' formed on the first and second side edges 58, 58', 59, and 59' of the elongated strap sections 14 and 14' for alternate attachment within the slot openings 57 and 57'formed in the transition sections 9 and 9' for preventing relative axial movement of the transition sections 9 and 9' and the elongated strap sections 14 and 14'. Each of the J-hook shaped tabs 60, and 60' may include a projection 64 and 64' and a distal end 65 and 65' and each of the J-hook tabs 66 and 66'' may include a projection 67 and 67' and a distal end 68 and 68'.

Preferably, the sheet elongated metal holdown strap connectors 7 and 7' are constructed so that the elongated strap sections 14 and 14' may be nailed to either side 6 or 62 of the vertical wood frame member 5 or 5'. This is best accomplished by providing a second row of slots 63 and 63' in the transition sections 9 and 9'. J-hook shaped tabs 66 and 66' may be formed with projections 67 and 67' and distal ends 68 and 68'.

In order to insure by structural configuration that the elongated strap sections 14 and 14' are attached so that each and every j-hooked tab is inserted into a slot, the slots may be longitudinally spaced one from another at varying intervals. The J-hooked tabs would then be spaced to register w1th the spaced slots. Another way to accomplish full attachment by structural configuration is to vary the size of the slots and their corresponding J-hooked tabs.

Figure 3:
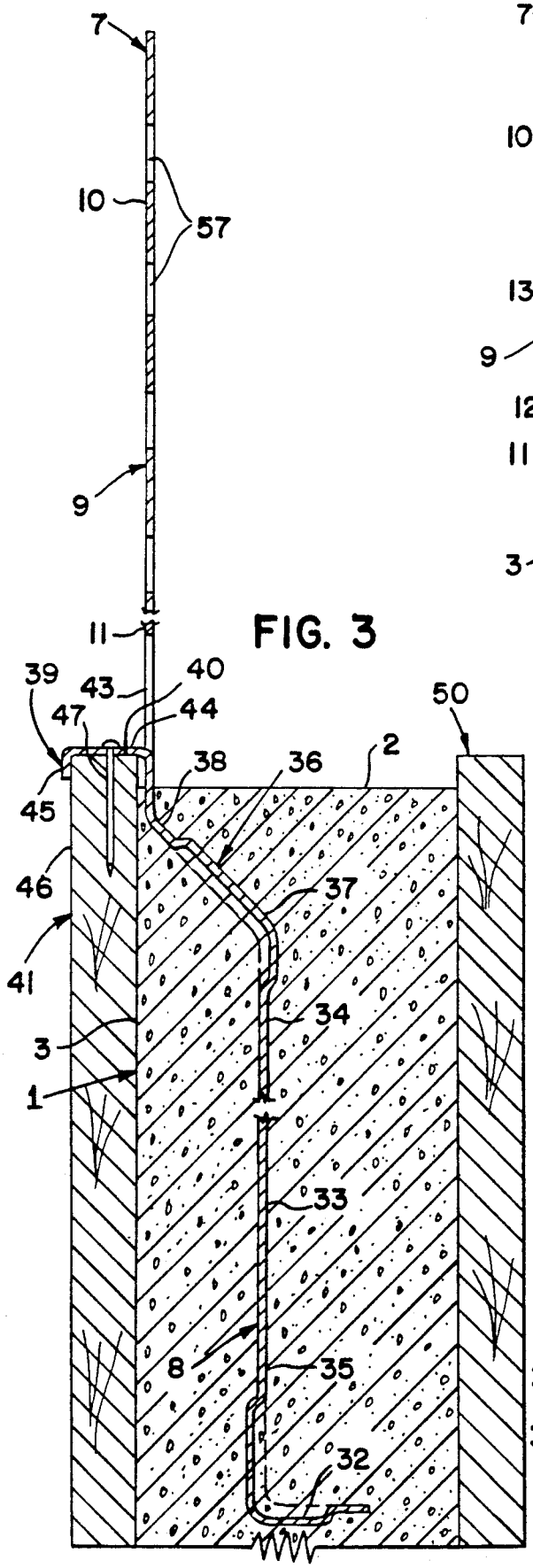
FIG. 3 is a cross sectional elevation view of a portion of the elongated sheet metal holdown strap illustrated in FIG. 1 set in a concrete foundation between two form boards. Note that both transition section and the foot section of the elongated sheet metal holdown strap member have been shortened so as to fit on the drawing sheet. In a normal installation the form boards will be removed after the concrete hardens. After the form boards are removed, the wood sill board is placed on the foundation and then the studs are attached to the wood sill board. The elongated strap section is omitted just as it would be during this stage of construction.
Figure 4:
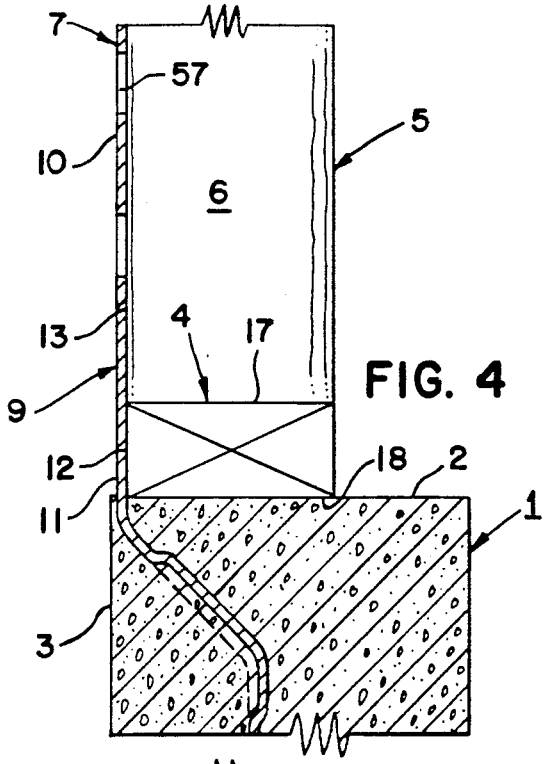
FIG. 4 is a side view of a portion of the elongated sheet metal holdown strap illustrated in FIG. 3 with the form boards removed and a mudsill and vertical wood frame installed. The elongated strap section has been omitted for clarity.
Figure 6:
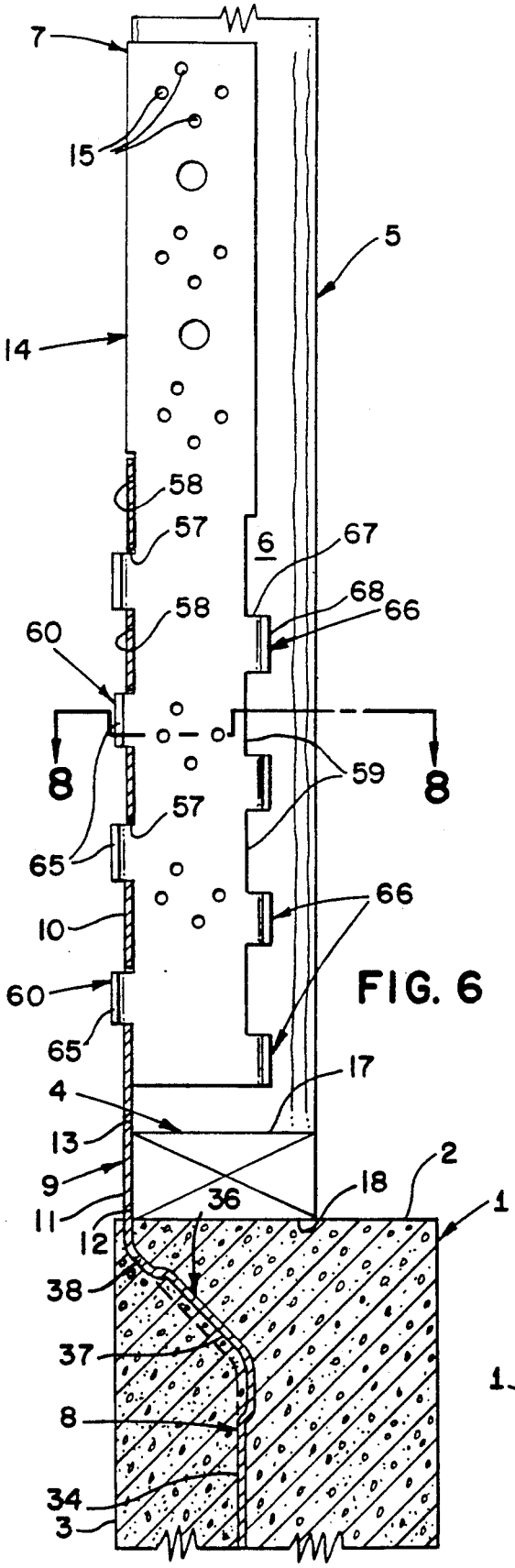
FIG. 6 is a side elevation view of a portion of one form of the holdown strap connection elongated sheet metal of the present invention with portions in cross section. The holdown strap is installed in a concrete foundation and attached to a vertical wood frame member placed on a mudsill.

In operation, the holdown strap connection may be made by referring to FIGS. 3, and 6. First, form boards 41 and 50 are set in place. Next, main portion 33 of foot section 8 is placed between the form boards in a generally vertical position and form attachment 39 is hooked over the top edge 40 of form board 41 and attached by fastener 47. The concrete is then poured between form boards 41 and 50 to form am upper surface 2. The form boards are stripped away and a mudsill 4 is placed on surface 2. A vertical wood frame member such as a stud or post 5 is then attached to the mudsill 4. Elongated strap section 14 is then positioned substantially vertically and in face to face alignment with transition section 9 at an elevation so that transition section attachment means 60 such as the J-hook tabs line up with strap section attachment means such as slots 57. The strap section 14 is then moved toward transition section 9 and when the projections 64 have fully penetrated slots 57, the strap section 14 is rotated counter clockwise 90°. Finally attachment members such as nails 16 are driven through fastener openings 15 in strap section 14 into vertical wood frame member 5.

Use of elongated sheet metal holdown strap connector 7' as illustrated in FIGS. 5 and 7 is similar to the installation of elongated sheet metal holdown strap connector 7 described immediately above and is not repeated.

Installation of the elongated sheet metal holdown strap connector 7'' as illustrated in FIGS. 13, 14, 16 and 18 is slightly different and is described herein. Form boards 41 and 50 are installed and main portion 33'' of foot section 8'' is placed between the form boards in a generally vertical position and transition section 9'' is placed over the top edge 40 of form board 41 and attached by fastener 52. The concrete is then poured between form boards 41 and 50 to form am upper surface 2. The form boards are stripped away and a mudsill 4 is placed on surface 2. A vertical wood frame member such as a stud or post 5 is then attached to the mudsill 4. Elongated strap section 14'' is then positioned substantially vertically by bending until transition section 9'' is in face to face registration with edge 13 of vertical frame member 5 and strap section 14'' is in face to face registration with side face 6 of wood frame member 5. Finally attachment members such as nails are driven through fastener openings 15'' in strap section 14'' into vertical wood frame member 5.

Installation of elongated sheet metal holdown strap connector 7'', as illustrated in FIGS. 15 and 17 is similar to the installation of elongated sheet metal holdown strap connector 7'' and is not here repeated.

We claim:

1. A holdown strap connection comprising:

a concrete foundation having an upper surface and a side surface;

b. a generally horizontally extending wood mudsill having an outside edge and an upper side and a lower side resting on said concrete foundation;

c. a rim joist member having an upper edge, a side, and a lower edge resting on said upper side of said wood mudsill;

d. a subfloor member having an upper face, an edge, and a lower face resting on said upper edge of said rim joist member;

e. a wood sole plate having an upper side, an edge and a lower side resting on said upper face of said subfloor member;

f. a generally vertical wood frame member having an outside edge and a side face and mounted on said wood upper side of said wood sole plate;

g. an elongated sheet metal holdown strap connector comprising:

1. a foot section embedded in said concrete foundation, 2. a transition section having an upper portion and a lower portion connected to said foot section and extending from said concrete foundation past said outside edge of said wood mudsill, along said side of said rim joist, along said edge of said subfloor; along said edge of said sole plate and along a portion of said edge of said vertical wood frame member, and 3. an elongated strap section connected to said upper portion of said transition section and extending and in registration with said side face of said vertical wood frame member and formed with a plurality of fastener openings therethrough; and h. fastener means dimensioned for insertion through said fastener openings in said elongated strap section of said elongated sheet metal holdown strap connector and into said vertical wood frame member.

2. A holdown strap connection as described in claim 1, further comprising:

a. said foot section including a distal end formed at an angle for mechanical interlock with said concrete foundation;

b. said foot section including a main portion having an upper section and a lower section integrally connected to said distal end and disposed in a generally vertical plane within said concrete foundation; and c. said foot section including a proximal section having a lower portion integrally connected to said main portion of said foot section and an upper portion integrally connected to said lower portion of said transition section; and d. a substantial length of said proximal section is disposed at an angle to said main portion of said foot section.

3. A holdown strap connection as described in claim 1 wherein:

a. said transition section and said elongated strap section of said elongated sheet metal holdown strap connector are integrally connected one to the other.

4. A holdown strap connection comprising:

a. a concrete foundation having an upper surface;

b. a generally horizontally extending wood mudsill resting on said concrete foundation;

c. a generally vertical wood frame member mounted on said wood mudsill and having an outside edge and a side face;

d. an elongated sheet metal holdown strap connector comprising:

1. a foot section embedded in said concrete foundation, 2. a transition section having an upper portion formed with strap section attachment means and a lower portion integrally connected to said foot section and extending from said concrete foundation past the outside edge of said wood mudsill and along a portion of said outside edge of said vertical wood frame member, and 3. an elongated strap section having first and second edges and formed with transition section attachment means formed for selected releasable attachment to said strap section attachment means formed in said transition section and extending and said elongated strap section being in registration with said side face of said vertical wood frame member and formed with a plurality of fastener openings therethrough; and e. fastener means dimensioned for insertion through said fastener openings in said elongated strap section of said elongated sheet metal strap and into said vertical wood frame member.

5. A holdown strap connection comprising:

a. a concrete foundation having an upper surface;

b. a generally horizontally extending wood mudsill having an upper side and a lower side resting on said concrete foundation;

c. a rim joist member having an upper edge and a lower edge resting on said upper side of said wood mudsill d. a subfloor member having an upper face and a lower face resting on said upper edge of said rim joist member;

e. a wood sole plate having an edge upper side and a lower side resting on said upper face of said subfloor member;

f. a generally vertical wood frame member mounted on said wood upper side of said wood sole plate and having an outside edge and a side face;

g. an elongated sheet metal holdown strap connector comprising:

1. a foot section embedded in said concrete foundation;

2. a transition section having an upper portion formed with strap section attachment means and a lower portion integrally connected to said foot section and extending from said concrete foundation past the outside edge of said wood mudsill, along said side of said rim joist, along said edge of said subfloor; along said edge of said sole plate and along a portion of said outside oedge of said vertical wood frame member;

3. an elongated strap section having first and second side edges formed with transition section attachment means formed for selected releasable attachment to said strap section attachment means formed in said transition section and extending and in registration with said side face of said vertical wood frame member and formed with a plurality of fastener openings therethrough; and h. fastener means dimensioned for insertion through said fastener openings in said transition section of said elongated sheet metal strap and into said vertical wood frame member.

6. A holdown strap connection as described in claims 4 or 5 wherein:

a. said strap section attachment means formed in said transition section are a plurality of slot openings; and b. said transition section attachment means formed in said elongated strap section are a plurality of hook shaped members dimensioned for receipt within said slot openings in said transition section for preventing relative axial movement of said transition section and said elongated strap section.

7. A holdown strap connection as described in claims 4 or 5 further comprising:

a. said transition section attachment means includes a plurality of J-hook shaped tabs formed on said first and second side edges of said elongated strap section for alternate attachment within said slot openings in said transition section for preventing relative axial movement of said transition section and said elongated strap section.

8. A holdown strap connection as described in claims 4 or 5 further comprising:

a. said transition section attachment means includes a pair of hook shaped members formed on said first and second side edges of said elongated strap section for alternate attachment within said slot openings in said transition section for preventing relative axial movement of said transition section and said elongated strap section; and b. said strap section attachment means formed in said transition section are a plurality of slot openings arranged in at least two side by side rows.

9. A holdown strap connection comprising:

a. a concrete foundation having an upper surface and a side surface;

b. a generally horizontally extending wood mudsill resting on said concrete foundation;

c. a generally vertical wood frame member having an outside dge mounted on said wood mudsill and having a side face;

d. an elongated one piece sheet metal holdown strap connector comprising:

1. a foot section embedded in said concrete foundation extending from within said concrete foundation to a location adjacent said side surface to said foundation;

2. a transition section having an upper portion and a lower portion integrally connected to said foot section and extending from said concrete foundation past said outside edge of said wood mudsill and along a portion of said outside edge of said vertical wood frame member, and 3. an elongated strap section integrally connected to said upper portion of said transition section and extending and in registration with said side face of said vertical wood frame member and formed with a plurality of fastener openings therethrough;

e. fastener means dimensioned for insertion through said fastener openings in said elongated strap section of said elongated sheet metal holdown strap connector and into said vertical wood frame member;

f. said foot section including a distal end formed at an angle for mechanical interlock with said concrete foundation;

g. said foot section including a main portion having an upper section and a lower section integrally connected to said distal end and disposed in a generally vertical plane within said concrete foundation;

h. said foot section including a proximal section having a lower portion integrally connected to said main portion of said foot section and an upper portion integrally connected to said lower portion of said transition section; and i. a substantial length of said proximal section is disposed at an angle to said main portion of said foot section.

10. A holdown strap connection comprising:

a. a concrete foundation having an upper surface and a side surface;

b. a generally horizontally extending wood mudsill resting on said concrete foundation;

c. a generally vertical wood frame member having an outside edge mounted on said wood mudsill and having a side face;

d. an elongated sheet metal holdown strap connector comprising:

1. a foot section embedded in said concrete foundation extending from within said concrete foundation to a location adjacent said side surface to said foundation;

2. a transition section having an upper portion and a lower portion integrally connected to said foot section and extending from said concrete foundation past said outside edge of said wood mudsill and along a portion of said outside edge of said vertical wood frame member, and 3. an elongated strap section connected to said upper portion of said transition section at a substantially ninety degree angle and extending and in registration with said side face of said vertical wood frame member and formed with a plurality of fastener openings therethrough;

e. fastener means dimensioned for insertion through said fastener openings in said elongated strap section of said elongated sheet metal holdown strap connector and into said vertical wood frame member; and f. said transition section and said elongated strap section of said elongated sheet metal holdown strap connector are integrally connected one to the other.

* * * * *